US009550279B2

(12) United States Patent
Dionne et al.

(10) Patent No.: US 9,550,279 B2
(45) Date of Patent: Jan. 24, 2017

(54) GARBAGE DISPOSAL INSTALLATION TOOL

(71) Applicants: John B. Dionne, Naples, FL (US); William Lamphere, Jr., Ledyard, CT (US)

(72) Inventors: John B. Dionne, Naples, FL (US); William Lamphere, Jr., Ledyard, CT (US)

( * ) Notice: Subject to any disclaimer, the term of this patent is extended or adjusted under 35 U.S.C. 154(b) by 76 days.

(21) Appl. No.: 14/309,947

(22) Filed: Jun. 20, 2014

(65) Prior Publication Data

US 2015/0033548 A1 Feb. 5, 2015

Related U.S. Application Data

(60) Provisional application No. 61/861,231, filed on Aug. 1, 2013.

(51) Int. Cl.
*B25B 9/00* (2006.01)
*E03C 1/266* (2006.01)

(52) U.S. Cl.
CPC ..... *B25B 9/00* (2013.01); *E03C 1/266* (2013.01); *Y10T 29/53* (2015.01)

(58) Field of Classification Search
CPC ..... B25B 27/023; B25B 27/064; B23P 19/025
See application file for complete search history.

(56) References Cited

U.S. PATENT DOCUMENTS 6,142,460 A 11/2000 Irwin
6,192,566 B1 * 2/2001 Dunum ..... B25B 27/0035 29/233
6,266,859 B1 * 7/2001 Hernandez ..... B25B 27/023 29/256
6,360,415 B1 * 3/2002 Wada ..... B21D 41/02 29/281.1
6,665,919 B1 * 12/2003 Kurtz ..... B25B 27/023 269/3
7,024,743 B2 4/2006 Heaton
7,401,392 B1 7/2008 Ramsey
7,685,689 B1 3/2010 Del Castello
7,726,631 B2 6/2010 Noe et al.
7,946,012 B2 5/2011 Cox et al.
8,931,153 B1 * 1/2015 Kimminau ..... B25B 13/48 29/255
2015/0033548 A1 * 2/2015 Dionne ..... B25B 9/00 29/700

* cited by examiner

*Primary Examiner* — Lee D Wilson
(74) *Attorney, Agent, or Firm* — Global Intellectual Property Agency, LLC

(57) ABSTRACT

A garbage disposal installation tool is provided that is adapted to support a garbage disposal from its upper opening and through the sink drain, whereby the disposal unit is supported from above while the installer secures the unit to the sink drain. The device comprises a tool body having an elongated, threaded rod with an upper end and a lower end. The upper end comprises a handle, while the lower end comprises a pivotable garbage disposal support member adapted to support the disposal unit from its upper opening and from the interior thereof. Along the threaded rod is a sink drain bridge element that is adapted to bear against the upper surface of a sink drain and support the tool body and the disposal unit therefrom. The bridge element is threaded to the elongated rod and positionable along its length to elevate the disposal unit by rotating the handle.

14 Claims, 7 Drawing Sheets

GARBAGE DISPOSAL INSTALLATION TOOL

CROSS REFERENCE TO RELATED APPLICATION

This application claims the benefit of U.S. Provisional Application No. 61/861,231 filed on Aug. 1, 2013. The above identified patent application is herein incorporated by reference in its entirety to provide continuity of disclosure.

BACKGROUND OF THE INVENTION

Field of the Invention

The present invention relates to plumbing tools and hand tools for installing sink equipment. More specifically, the present invention pertains to a garbage disposal installation tool in which the garbage disposal can be supported by the tool without requiring the installer to manually support the disposal while connecting the same to the drain.

Garbage disposals were well known devices in the art that grind solid waste entered into a sink drain to allow the waste to be evacuated through the household plumbing. These devices are means of disposing solid, biodegradable food products using the plumbing system and wastewater treatment plants as a means of processing the waste. These devices reduce landfill waste and capitalize on existing treatment of wastewater for processing organic material, and further provide a convenient way for a consumer to remove food waste from their home in immediate fashion, as opposed to storing it in a waste bin that can attract animals and pests, cause undesirable smells, and contaminate waste receptacles.

Garbage disposal units are secured below a sink drain in between the drain and the trap below the sink, providing a means to grind food products into smaller, more fluid particles that can be evacuated through the existing plumbing. Installing these devices involves replacing a standard sink drain with one that is compatible with a disposal unit, connecting the disposal unit to the drain, wiring the unit, and then securing the plumbing thereto. This exercise is well understood in the plumbing arts and astute, do-it-yourself homeowners. It is also well understood that garbage disposals tend to be large, electromechanical devices having a non-negligible weight during installation.

During the process of connecting the upper portion of the garbage disposal unit to the sink drain, the installer is required to lift and support the disposal unit while fastening the same. This may be alleviated via more clever attachment means, however generally the user has to either support the disposal with one hand while securing fasteners with another, or utilize a support stand below the disposal unit during installation. Neither of these alternatives is attractive, as it can be difficult to coordinate the attaching of the unit while holding the same, while also the underside of a sink tends generally to be cluttered, making the use of a support stand not advantageous or even feasible.

The present invention discloses a new tool in the art of garbage disposal units that facilitates installation without consuming space below the sink, and one that can support the disposal unit without interaction by the user while fastening the same to the sink drain. The device comprises a tool body that is positioned through the sink drain, and includes a rotatable garbage disposal support member at the lower end thereof and a drain bridge element along the length thereof. The garbage disposal support member is a rotatable member supporting the garbage disposal by its upper aperture, while the drain bridge element is adapted to bear against the sink drain and span the diameter thereof. The drain bridge element supports the tool body and the disposal unit from the sink drain, allowing the installer to fasten the disposal unit. The relative position of the drain bridge element to the disposal unit controls the position of the disposal unit, while the pressure applied to the sink drain can facilitate sealing of the same if the sink drain is replaced in the installation procedure. The tool of the present invention advances the art and provides a novel means of supporting a garbage disposal unit during installation that reduces strain on the part of the user and does not consume space below the sink.

Description of the Prior Art

Devices have been disclosed in the prior art that relate to garbage disposal unit support devices and installation tools. These include devices that have been patented and published in patent application publications, and generally relate to devices that support disposal units from below, wherein a support is provided that lifts or otherwise supports a disposal unit from beneath the sink. The following is a list of devices deemed most relevant to the present disclosure, which are herein described for the purposes of highlighting and differentiating the unique aspects of the present invention, and further highlighting the drawbacks existing in the prior art.

One such device that exemplifies the art is U.S. Pat. No. 6,142,460 to Irwin, which discloses an apparatus for installing and removing a sink mounted garbage disposal, wherein the device supports the garbage disposal from the underside thereof. The device comprises a base that is positioned along the floor underneath the sink, a telescoping post upstanding from the base with means of locking the height thereof, and a disposer support platform assembly at the top of the telescoping post. The support platform assembly supports the disposer from below as the installer connects the upper portion of the disposal to the sink drain.

In a similar fashion as the Irwin device, other garbage disposal support devices and installation tools are presented in the art that support disposal units from the underside thereof and utilize the floor below the sink as a means to support the disposal during installation. These include U.S. Pat. No. 7,024,743 to Heaton, U.S. Pat. No. 7,685,689 to Del Castello, U.S. Pat. No. 7,401,392 to Ramsey, and U.S. Pat. No. 7,726,631 to Noe. Heaton utilizes an upstanding and extendable threaded rod to position a garbage disposal support adapter in an opportune position during installation. Similarly, Del Castello provides a threaded rod extending upwards from a base, wherein there is further provided a flat top platform and a lever bar that transforms rotation thereof into axial motion of the threaded rod, and thus repositioning of the flat top platform. Ramsey advances the art by introducing a hydraulic jack as a means to extend a garbage disposal from a base, while finally Noe provides a screw jack mechanism and a notched platform that accommodates the electrical wiring of the garbage disposal.

These prior art devices share common drawbacks that limit their use, and simultaneously do not address the needs of supporting a garbage disposal under a sink during installation where the space under the sink is generally limited, cluttered, or occupied by water catch basins. These prior art devices require substantial space below the sink, and are useful only when there is sufficient clearance therein and between the disposal unit and the sink drain. These devices provide a lifting support from below the disposal unit, wherein most comprise stands or jack assemblies that rely on the sink floor as a means of support.

The present invention, by contrast, incorporates a structure that is adapted to support a disposal unit from the sink drain itself, wherein the body of the tool is inserted through the sink drain and the disposal unit is suspended therefrom. This eliminates the need for a minimum space requirement under the sink, as the tool consumes space within the drain and an area thereabove. The tool comprises a sink drain bridge element threadably attached thereto, whereby the bridge element bears against the sink drain and supports a disposal unit to be installed or being removed via a rotatable disposal unit support element engaged through the upper opening of the unit. During installation or removal, the user can rotate the handle of the device, which changes the proportion of the tool body above and below the bridge element, thereby raising or lowering the disposal underneath the sink drain. The user does not have to support both the tool and the disposal unit during operation, and is free to secure or remove the disposal unit when the tool is being deployed.

It is submitted that the present invention is substantially divergent in design elements from the prior art, and consequently it is clear that there is a need in the art for an improvement to existing garbage disposal installation devices. In this regard the instant invention substantially fulfills these needs.

SUMMARY OF THE INVENTION

In view of the foregoing disadvantages inherent in the known types of garbage disposal installation tools now present in the prior art, the present invention provides a new tool that can be utilized for providing convenience for the user when supporting a garbage disposal from the sink drain itself and without requiring the user actively hold the disposal unit during installation or removal thereof.

It is therefore an object of the present invention to provide a new and improved garbage disposal installation tool that has all of the advantages of the prior art and none of the disadvantages.

It is another object of the present invention to provide a garbage disposal installation tool to provide a means of supporting a garbage disposal unit during installation or removal without consuming space below the sink in the process.

Another object of the present invention is to provide a garbage disposal installation tool that can be supported from the sink drain itself and used to raise and lower the disposal unit relative thereto without requiring the user to manually lift or lower the unit.

Yet another object of the present invention is to provide a garbage disposal installation tool that can facilitate installation of a garbage disposal unit while also applying pressure to a newly installed garbage disposal sink drain, assisting the creation of a seal between the sink drain and the sink itself via the application of pressure.

Another object of the present invention is to provide a garbage disposal installation tool that includes a generic garbage disposal unit support along its lower end, requiring no particular fitting or assembly to support a garbage disposal unit from its upper opening.

A final object of the present invention is to provide a garbage disposal installation tool that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
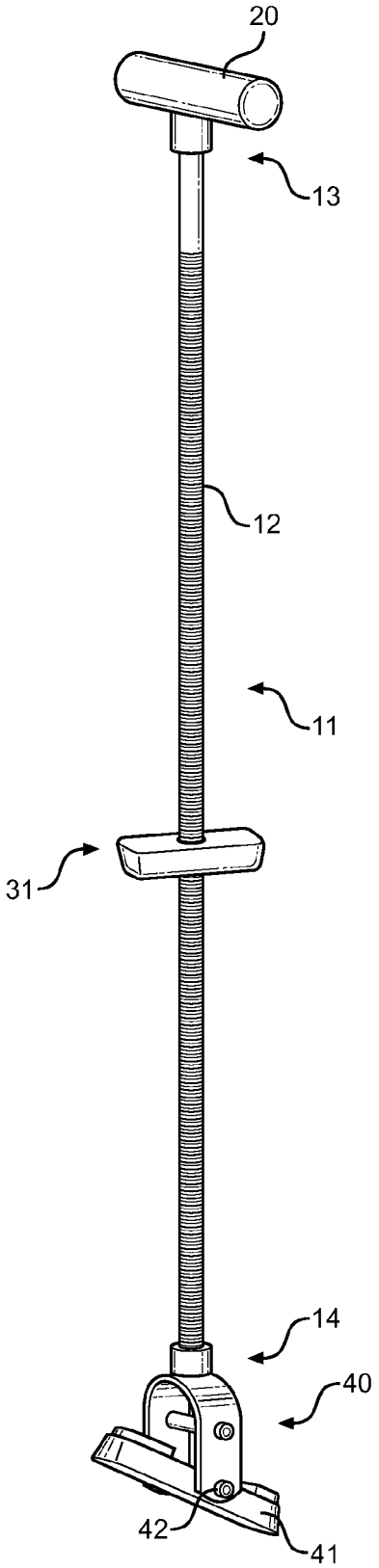
FIG. 1 shows a perspective view of an embodiment of the garbage disposal installation tool of the present invention.

Reference is made herein to the attached drawings. Like reference numerals are used throughout the drawings to depict like or similar elements of the garbage disposal unit installation tool of the present invention. For the purposes of presenting a brief and clear description of the present invention, the preferred embodiment will be discussed as used for installing or removing a garbage disposal unit from a sink drain without consuming space below the sink and supporting the disposal unit from the sink drain itself. The figures are intended for representative purposes only and should not be considered to be limiting in any respect.

Referring now to FIG. 1, there is shown a perspective view of the garbage disposal installation tool. This view shows a first embodiment of the present invention. The tool comprises a tool body 11 having an upper end 13 and a lower end 14, whereby the lower end 14 is adapted to engage a garbage disposal unit and the upper end 13 is adapted to provide a user handle 20. The tool body 11 itself is an elongated, threaded rod 12 that supports a sink drain bridge element 31 along its length. The sink drain bridge element 31 is an elongated member having a length extending in equal proportions substantially perpendicularly outward from the threaded rod, wherein the length is adapted to be wider than the diameter of a sink drain. This allows the element 31 to span the opening of the sink drain and support the tool body 11 therefrom. In this position the handle 20 is disposed above the sink and the tool body lower portion 13 is positioned below the sink, as the elongated rod 12 extends through the sink drain during use.

The sink drain bridge element 31 comprises a central threaded aperture that has a complimentary thread pitch and direction in relation to the threaded rod 12. In this way, the bridge element 31 is operably positionable along the threaded rod 12 length by rotating the element 31 in either a clockwise or counterclockwise manner, thereby changing the relative position of the tool body lower portion 14 and the bridge element 31. With this threaded relationship, raising or lowering of a garbage disposal can be accomplished by rotating the handle 20 of the tool body while the bridge element 31 bears against a sink drain upper surface, thereby raising or lowering the lower portion 14 of the tool body and the disposal unit being supported. This raises or lowers a garbage disposal unit below the sink, allowing the installer to comfortably raise or lower the disposal unit without lifting the same or lifting the tool body in any way. The user can simply rotate the handle 20 for height adjustment of the disposal unit. The handle 20 itself is preferably an enlarged T-shape having a first and second handle portion extending substantially perpendicularly outward from the threaded rod 12.

Figure 2:
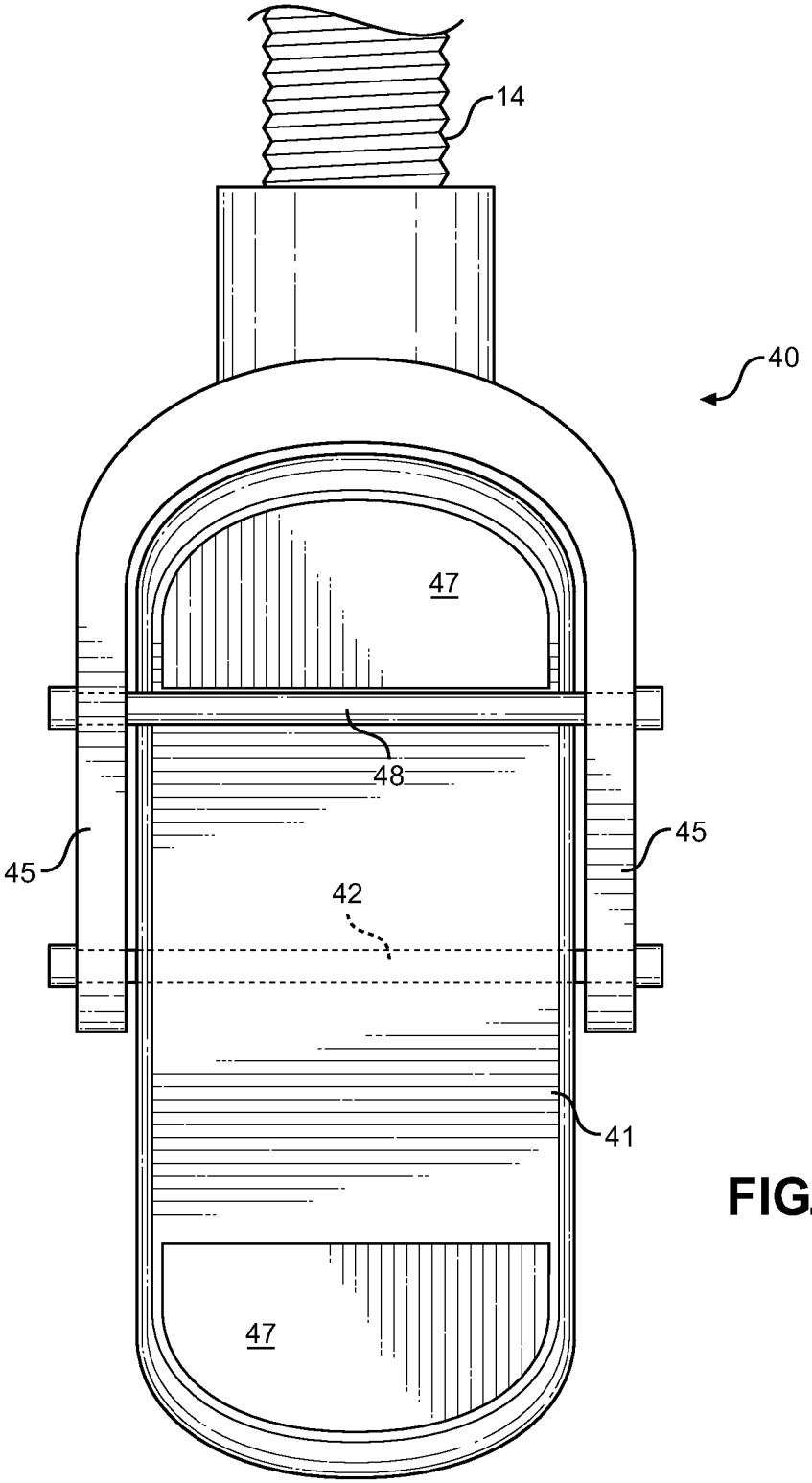
FIG. 2 shows a view of an embodiment of the rotatable garbage disposal support member within its supporting clevis member.
Figure 3:
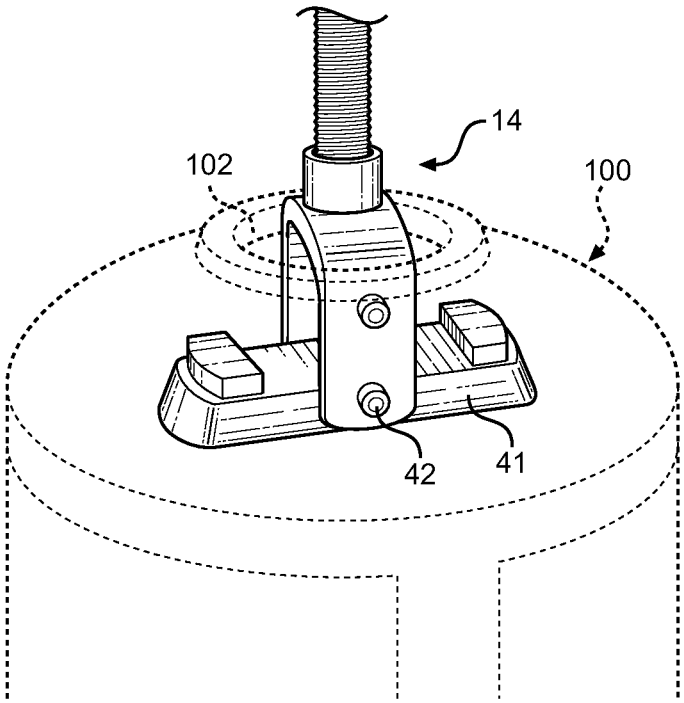
FIG. 3 shows a view of the present invention in a working state and its lower portion engaging the upper opening of a garbage disposal unit below the sink drain.

Referring now to FIGS. 2 and 3, visualization of the tool body lower portion 14 of the first embodiment is provided. The lower portion 14 of the first embodiment comprises a clevis member 40 having a first and second clevis arm 45. the clevis 40 is adapted to rotatably support a garbage disposal support member 41 between the clevis arms 45 and via a hinge pin member 42 extending therebetween. The garbage disposal support member 41 is comprised of an elongated body having a length and an aperture that accepts a hinge pin 42 therethrough, which establishes the center of rotation of the support member 41 such that the member 41 can pivot between a vertical and a horizontal state within the clevis 40.

In operation, the garbage disposal support member 41 can be rotated between a vertical orientation and a horizontal orientation to facilitate insertion thereof through the sink drain interior and through the upper opening of a garbage disposal unit. FIG. 2 illustrates the garbage disposal support member 41 in a vertical orientation, which aligns its length with the tool body. Referring to FIG. 3, when positioned through the sink drain interior 61 and through the upper opening 102 of the garbage disposal 100, the garbage disposal support member 41 is rotated into a horizontal position. This positions the length of the garbage disposal support member 41 across the opening 102 of the garbage disposal 100 such that the support member 41 can support the garbage disposal from the interior surface thereof.

Referring to FIG. 2, there is shown a frontal view of the clevis member 40 supporting the garbage disposal support member 41 in a vertical state. The support member 41 comprises a length and a first and second protrusion 47 along the outer portions of its length. The protrusions 47 act as support pads for supporting the garbage disposal unit from within its interior, but also act as locking members, whereby one of the protrusions can be secured within the clevis between the clevis arms 45 and a secondary pin 48. The protrusions 47 are sized to secure snugly within the cavity created between the secondary pin 48 and the clevis interior, whereby the protrusion 47 effectively maintains the vertical positioning of the support member 41 during insertion through the drain interior and the disposal unit. In the configuration of FIG. 2, the support member 41 is rotatable between an orientation parallel to said elongated rod and perpendicular thereto in a 180 degree sweep, whereby the support member 41 is rotatable in either direction when transitioning from horizontal to vertical.

Figure 4:
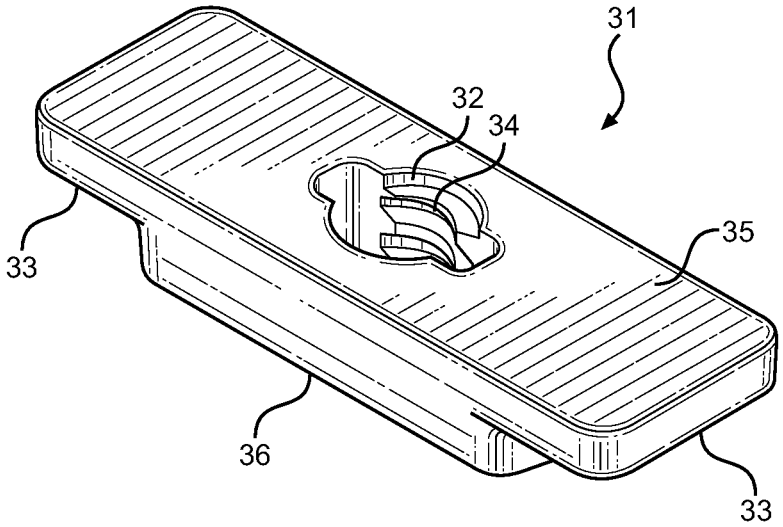
FIG. 4 shows an exemplary embodiment of the drain bridge element of the present invention.
Figure 5:
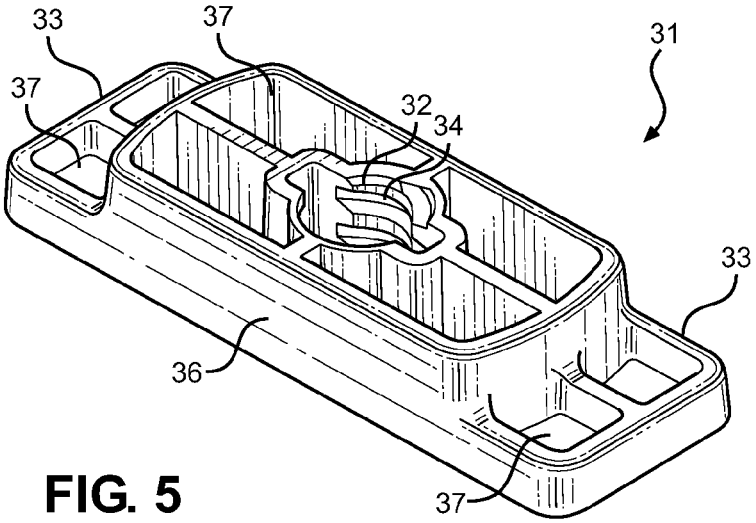
FIG. 5 shows an underside view of the exemplary embodiment of the drain bridge element of the present invention.

Referring now to FIGS. 4 and 5, there is shown a second, exemplary embodiment of the sink drain bridge element 31 of the present invention. In this embodiment, the bridge element 31 comprises an elongated length with a first and second end 33. The ends 33 comprise a thickness and flank the larger body portion 36 of the bridge element 31. The body portion 36 supports a threaded aperture 32 having a thread pitch 34 such that the bridge element 31 can engage and be supported by the threaded rod of the tool body. Therefore the body portion 36 has a greater thickness to support a length of threading to sufficiently engage the tool body threading. The bridge element 31 further comprises a flat upper surface 35 along its length, while the lower surface of the first and second end 33 are adapted to bear against the periphery of a sink drain. This allows the bridge element 31 to bear against a sink drain and allow the thicker body portion 36 to enter the sink drain interior. In a preferred construction, the bridge element comprises a molded or cast part having hollow portions 37 along the body portion 36 and the outer ends 37.

Figure 6:
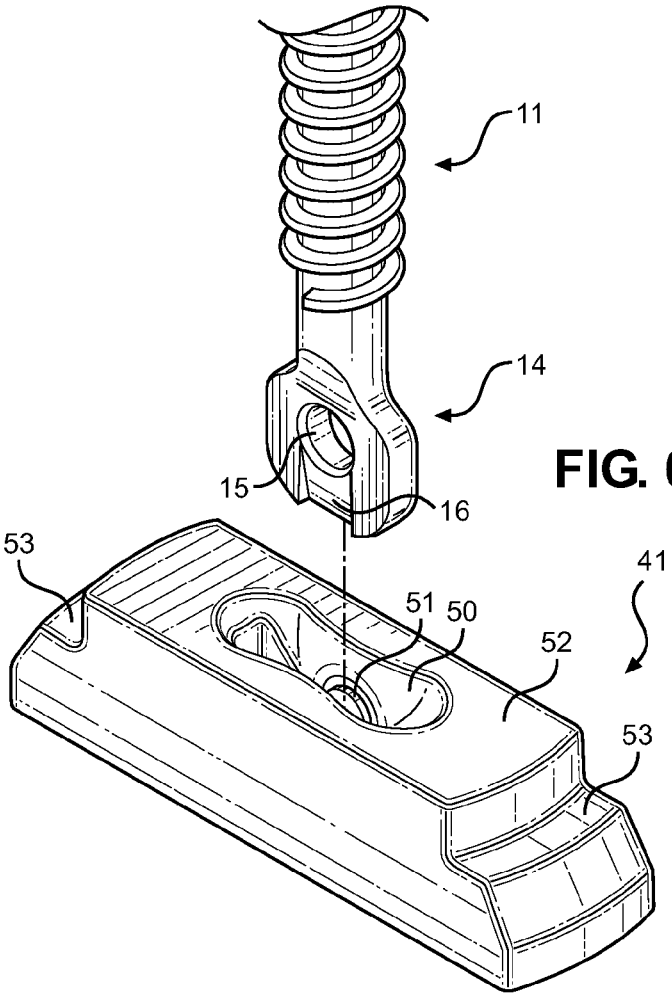
FIG. 6 shows a view of an exemplary embodiment of the garbage disposal support member and the connection to the tool body lower end.
Figure 7:
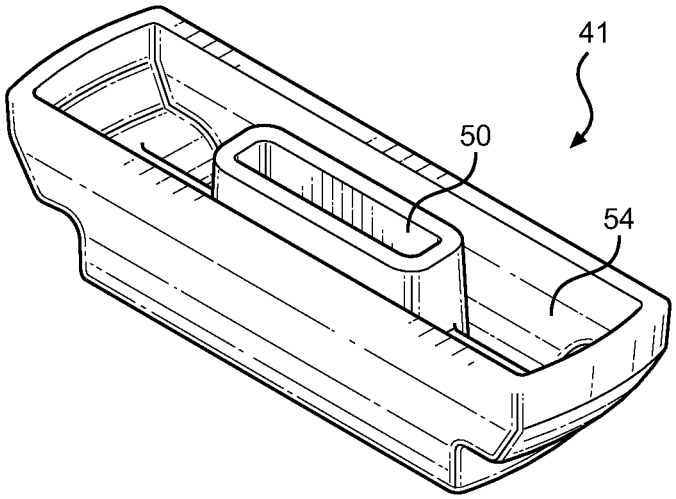
FIG. 7 shows an underside view of the exemplary embodiment of the garbage disposal support member.
Figure 8:
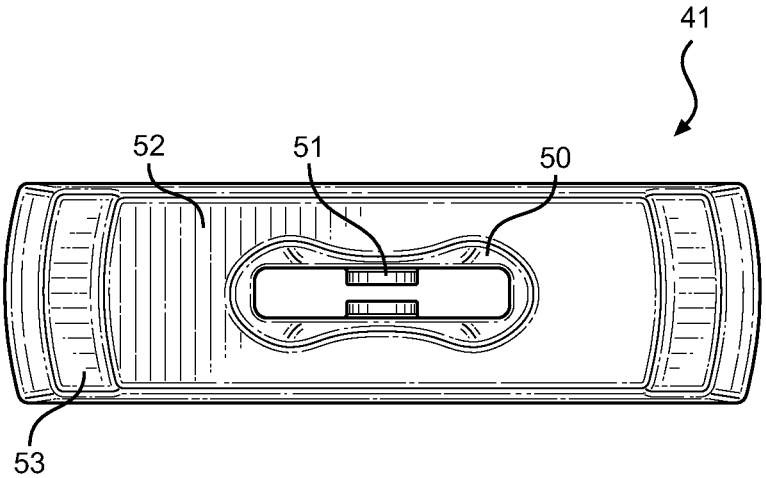
FIG. 8 shows an overhead view of the exemplary embodiment of the garbage disposal support member.

Referring now to FIGS. 6 through 8, there are shown views of the exemplary embodiment of the garbage disposal support member 41 of the present invention. In this embodiment, the support member 41 comprises an elongated length and a central slot 50 that engages a flat end of the tool body lower end 14. The central slot 50 comprises a through-way that is wider than the flat end of the tool body lower 14, whereby the two once engaged can pivot in-plane a given degree to allow the support member 41 to pivot between a horizontal state and an angled or substantially vertical state.

Within the slot 50 is a first and second rounded protrusion 51 that extend inward toward one another. The protrusions 51 are separated by a small gap such that the flat end of the tool body lower end 14 can pass therebetween and lock the protrusions 51 into a central aperture 15 in the flat end. A channel 16 of reduced thickness is provided along the flat end. This channel 16 is comprised of a tapered thickness such that the protrusions 51 can pass thereover and the channel 16 can slide therebetween, whereafter the protrusions 51 engage the central aperture 15 and snap into place. This snap fitting between the protrusions 51 and the central aperture 15 allow engagement of the support member 41 and the tool body lower end 14, while also allow disassembly if required. The channel 16 extends from the outer edge of the flat end to the aperture to facilitate the protrusions 51 of the support member 41 sliding thereover and into the central aperture.

The support member 41 itself comprises an elongated length having a raised central portion 52 and stepped-down end portions 53 flanking the central portion. Depending on the size of the garbage disposal unit, the end portions 53 support a disposal unit from within the unit, or the raised central portion 52 may contribute and directly bear against the interior surface of the disposal unit while in use. It is preferred that the support member 41 comprise a substantially hollow underside structure 54, whereby the member 41 is a molded or cast part.

Figure 9:
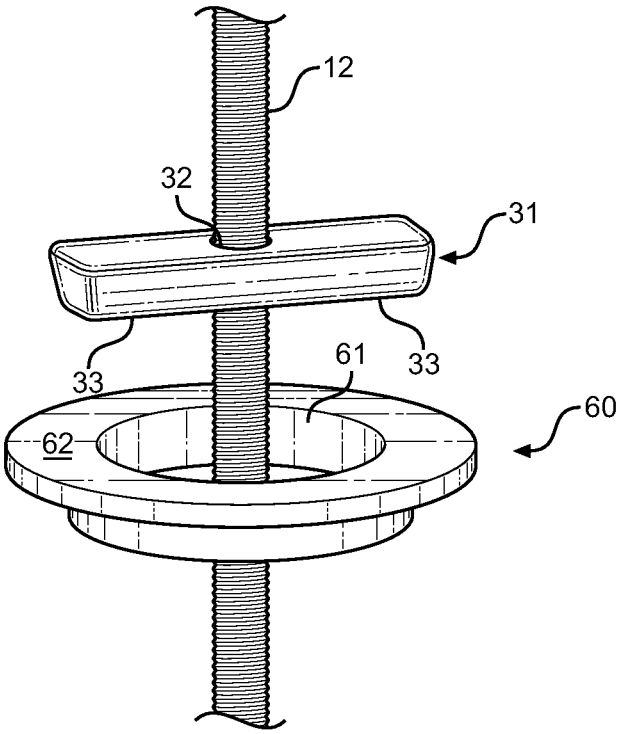
FIG. 9 shows the drain bridge element in relation to a sink drain.
Figure 10:
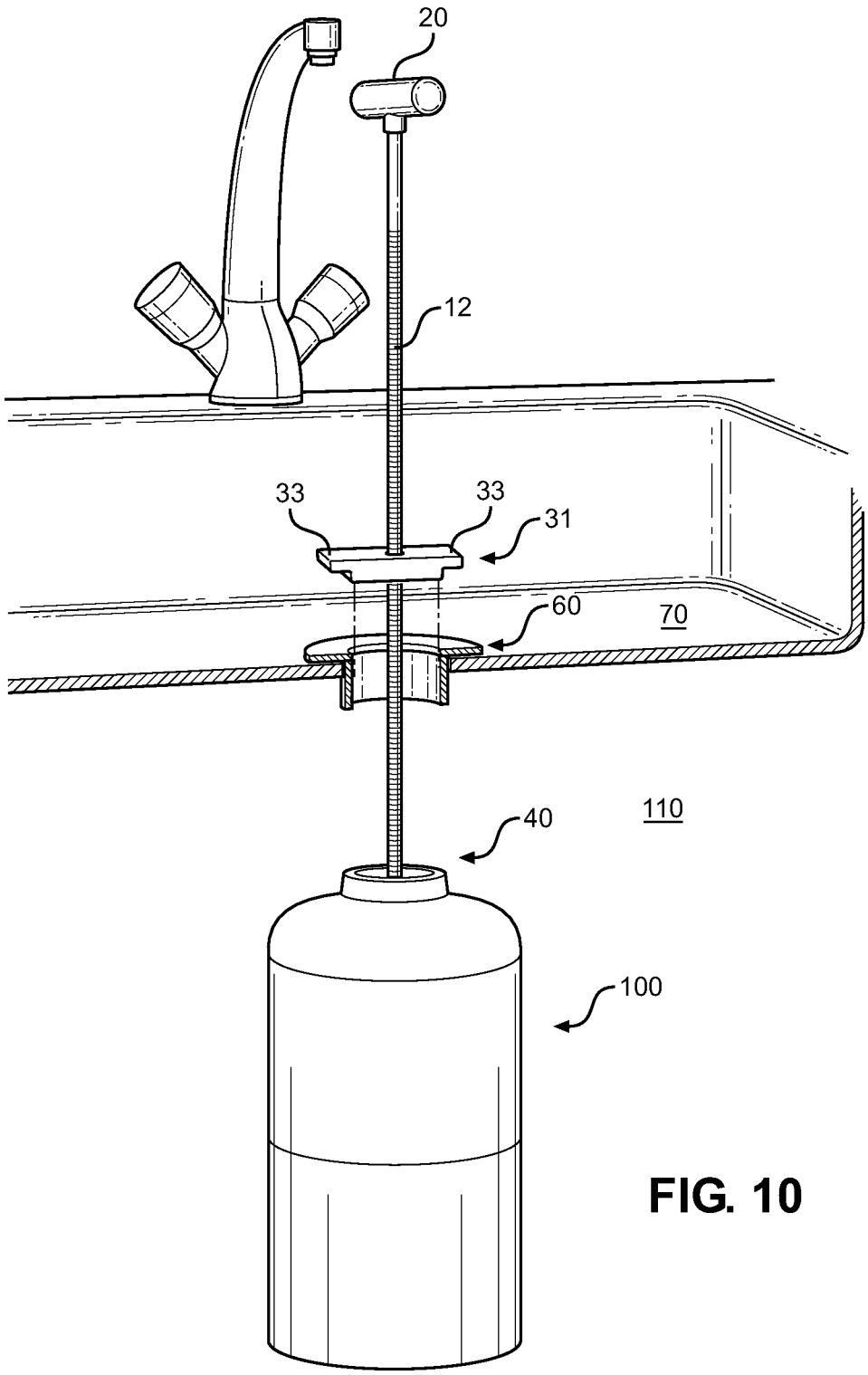
FIG. 10 shows a view of the present invention in a working state, supporting a garbage disposal unit under the sink prior to installation.

Referring now to FIGS. 9 and 10, there are shown views of the tool body inserted through both the sink drain 60 and into the garbage disposal unit 100 open upper, whereby the tool is in a working state supporting the disposal unit 100. After the tool lower end 14 is inserted through the interior 61 of the sink drain 60 and into the upper opening 102 of the disposal unit 100, the user can rest the tool against the upper surface 62 of the sink drain 60. The sink drain bridge element 31, which comprises an extended length, outer ends 33, and a threaded central aperture 32, is positioned along the threaded rod 12 at a given distance from the tool lower end 14. The bridge element 31 bears against the upper surface 62 of the sink drain 60 and the sink itself, supporting the disposal unit 100 and the tool lower end 14 below the sink. The weight of the disposal unit 100 and the tool body bear against the sink drain 60, which can facilitate sealing the same if the sink drain is replaced during installation of the disposal unit 100. Generally a line of putty or adhesive sealant is applied between the new sink drain 60 and the sink 70. The load applied by the bridge element 31 facilities clamping the two together as the seal sets.

Along with facilitating the seal between the sink drain 60 and the sink 70, the tool supports a disposal unit 100 underneath 110 the sink. This is accomplished without additional supports below the sink, consuming very little space under the sink during installation or removal, and all-but eliminating the need for the user to physically handle the disposal unit 100 during the same. During installation, the user positions the tool body through the sink drain 60 and engages the disposal unit using the tool lower end. The tool is self-supported by the bridge element 31 bearing against the sink drain upper surface 62. The user can then raise the disposal unit 100 by rotating the handle 20, which rotates the threaded rod 12 relative to the now-stationary bridge element 31. The threads cause the rod 12 to rise, thereby raising the disposal unit 100 in the process. Once the disposal unit 100 is abutted against the sink drain itself, the user can secure the unit in an appropriate fashion. This may include a mounting flange, fasteners, or similar attachment scheme that is provided by the specific garbage disposal unit manufacturer. The reverse process can be followed to remove an existing disposal unit from the sink using the tool of the present invention.

Overall, the present invention facilitates installation and removal of disposal units without consuming space below the sink, and without requiring the user to manually position, lift or lower the disposal unit during the process. This allows the user to have two free hands for installing or disconnecting the disposal. The tool supports the disposal sink securely from its upper opening and through the sink drain interior. It is contemplated that the present invention be utilized by both professionals and for personal use, wherein the tool facilitates ease of handling the disposal unit with a simple and useful tool.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A garbage disposal installation tool, comprising:

a tool body comprising an elongated rod having an upper end, a lower end, and a length;

said elongated rod having outer surface threading comprising a thread pitch substantially along the length of said elongated rod;

said upper end comprising a handle grip;

said lower end comprising a rotatable garbage disposal support member;

said rotatable garbage disposal support member adapted to be inserted into a garbage disposal interior and rotated to support the garbage disposal across an upper opening of said garbage disposal;

wherein said garbage disposal support member further comprises an elongated length, a raised central portion, and stepped-down end portions flanking said central portion;

a sink drain bridge element disposed along said elongated rod length, said sink drain bridge element being threadably connected to said elongated rod via a threaded aperture;

said sink drain bridge element having a length adapted to be greater than a standard sink drain opening, whereby said sink drain bridge element is adapted be positioned over the standard sink drain opening to support said tool body and a garbage disposal under said sink drain.

2. The garbage disposal installation tool of claim 1, wherein:

said lower end further comprises a clevis member having a first and second arm;

a pin extending between said first and second arm;

said garbage disposal support member being rotatably supported by said pin.

3. The garbage disposal installation tool of claim 1, wherein:

said garbage disposal support member extends equally outward from said elongated rod.

4. The garbage disposal installation tool of claim 1, wherein:

said garbage disposal support member extends equally outward from said elongated rod;

said garbage disposal support member being rotatable between an orientation parallel to said elongated rod and perpendicular thereto in a 180 degree sweep.

5. The garbage disposal installation tool of claim 1, wherein:

said lower end further comprises a clevis member having a first and second arm;

a pin extending between said first and second arm;

said garbage disposal support member being rotatably supported by said pin;

said garbage disposal support member extends equally outward from said elongated rod;

said garbage disposal support member being rotatable between an orientation parallel to said elongated rod and perpendicular thereto in a 180 degree sweep;

said garbage disposal support member further comprising upstanding protrusions adapted to snugly fit between said first and second arm of said clevis member to prevent rotation of said garbage disposal support member through said clevis member.

6. The garbage disposal installation tool of claim 1, wherein:

said lower end further comprises a clevis member having a first and second arm;

a pin extending between said first and second arm;

said garbage disposal support member being rotatably supported by said pin;

said garbage disposal support member extends equally outward from said elongated rod;

said garbage disposal support member being rotatable between an orientation parallel to said elongated rod and perpendicular thereto in a 180 degree sweep;

a secondary pin between said first and second arm of said clevis member;

said garbage disposal support member further comprising upstanding protrusions adapted to snugly fit between said first and second arm of said clevis member and said secondary pin to prevent rotation of said garbage disposal support member through said clevis member.

7. The garbage disposal installation tool of claim 1, wherein:

said lower end further comprises a flat end having an outer edge, a central aperture, and a channel comprising a reduced thickness extending between said outer edge and said central aperture;

said garbage disposal support member further comprising a central slot adapted to receive said flat end;

said central slot being wider than said flat end such that said garbage disposal support member can pivot relative to said flat end when connected;

said central slot further comprising a first and second protrusion being separated by a small gap;

said channel of said flat end adapted to be slidable through said small gap and said first and second protrusion being sized to snap into said central aperture of said flat end.

8. The garbage disposal installation tool of claim 1, wherein said garbage disposal support member comprises a hollow underside construction.

9. The garbage disposal installation tool of claim 1, wherein said sink drain bridge element further comprises:

an elongated length with a first and second end and a flat upper surface;

a central body portion between said first and second end, said central body portion being thicker than said first and second end;

a threaded aperture through said central body region.

10. The garbage disposal installation tool of claim 1, wherein said sink drain bridge element further comprises:

an elongated length with a first and second end and a flat upper surface;

a central body portion between said first and second end, said central body portion being thicker than said first and second end;

a threaded aperture through said central body region;

said sink drain bridge element having a hollow underside construction.

11. The garbage disposal installation tool of claim 1, wherein:

said handle grip further comprises a T-shaped handle having a first and second handle portion extending substantially perpendicular from said elongated rod.

12. The garbage disposal installation tool of claim 1, wherein:

said sink drain bridge element is positionable along said length of said elongated rod by rotating said drain bridge element, whereby said threaded connection advances said sink drain bridge element in an upward or downward direction based on the direction of said thread pitch.

13. A garbage disposal installation tool, comprising:

a tool body comprising an elongated rod having an upper end, a lower end, and a length;

said elongated rod having outer surface threading comprising a thread pitch substantially along the length of said elongated rod;

said upper end comprising a handle grip;

said lower end comprising a rotatable garbage disposal support member;

said rotatable garbage disposal support member adapted to be inserted into a garbage disposal interior and rotated to support the garbage disposal across an upper opening of said garbage disposal;

wherein said garbage disposal support member extends equally outward from said elongated rod;

wherein said garbage disposal support member is rotatable between an orientation parallel to said elongated rod and perpendicular thereto in a 180 degree sweep;

a sink drain bridge element disposed along said elongated rod length, said sink drain bridge element being threadably connected to said elongated rod via a threaded aperture;

said sink drain bridge element having a length adapted to be greater than a standard sink drain opening, whereby said sink drain bridge element is adapted be positioned over the standard sink drain opening to support said tool body and a garbage disposal under said sink drain.

14. A garbage disposal installation tool, comprising:

a tool body comprising an elongated rod having an upper end, a lower end, and a length;

said elongated rod having outer surface threading comprising a thread pitch substantially along the length of said elongated rod;

said upper end comprising a handle grip;

said lower end comprising a rotatable garbage disposal support member;

wherein said lower end further comprises a clevis member having a first and second arm;

a pin extending between said first and second arm;

said garbage disposal support member being rotatably supported by said pin;

said rotatable garbage disposal support member adapted to be inserted into a garbage disposal interior and rotated to support the garbage disposal across an upper opening of said garbage disposal;

a sink drain bridge element disposed along said elongated rod length, said sink drain bridge element being threadably connected to said elongated rod via a threaded aperture;

said sink drain bridge element having a length adapted to be greater than a standard sink drain opening, whereby said sink drain bridge element is adapted be positioned over the standard sink drain opening to support said tool body and a garbage disposal under said sink drain.

* * * * *